US006345952B1

(12) United States Patent
Oeynhausen et al.

(10) Patent No.: US 6,345,952 B1
(45) Date of Patent: Feb. 12, 2002

(54) STEAM TURBINE

(75) Inventors: Heinrich Oeynhausen; Wilfried Ulm, both of Mülheim an der Ruhr; Ralf Bell, Kerken; Ulrich Capelle, Oberhausen; Jan-Erik Mühle; Mikhail Simkine, both of Mülheim an der Ruhr; Ingo Stephan, Görlitz; Volker Simon, Mülheim an der Ruhr, all of (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 09/352,991

(22) Filed: Jul. 14, 1999

Related U.S. Application Data

(63) Continuation of application No. PCT/DE98/00063, filed on Jan. 9, 1998.

(30) Foreign Application Priority Data

Jan. 14, 1997 (DE) ..... 197 01 020

(51) Int. Cl.[7] ..... F01D 1/04; F01D 3/04

(52) U.S. Cl. ..... 415/100; 415/93; 415/103; 415/107; 415/108

(58) Field of Search ..... 415/93, 99, 100, 415/101, 102, 103, 107, 108, 181, 199.5, 902

(56) References Cited

U.S. PATENT DOCUMENTS

| | | | | | |
|---|---|---|---|---|---|
| 1,622,805 | A | | 3/1927 | Pape | |
| 1,750,814 | A | | 3/1930 | Pape | |
| 1,827,682 | A | * | 10/1931 | Weidehoff | 415/103 |
| 3,107,084 | A | * | 10/1963 | Conrad, Sr. et al. | 415/93 |
| 3,277,652 | A | * | 10/1966 | Brown | 415/101 |
| 3,754,833 | A | * | 8/1973 | Remberg | 415/108 |
| 3,973,404 | A | * | 8/1976 | Iizuka et al. | 415/101 |
| 4,403,915 | A | * | 9/1983 | Teufelberger | 415/199.5 |

FOREIGN PATENT DOCUMENTS

| | | | | |
|---|---|---|---|---|
| DE | 312856 | * | 6/1919 | 415/199.5 |
| DE | 518 786 | | 2/1931 | |
| DE | 880307 | * | 6/1953 | 415/199.5 |
| DE | 1016719 | * | 10/1957 | 415/103 |
| DE | 20 54 465 B2 | | 5/1972 | |
| DE | 30 06 286 A1 | | 8/1981 | |
| EP | 43602 | * | 1/1982 | 415/104 |
| FR | 379 478 | | 11/1907 | |
| GB | 236961 | | 10/1925 | |
| GB | 293037 | * | 10/1928 | 415/199.5 |

* cited by examiner

*Primary Examiner*—Christopher Verdier
(74) *Attorney, Agent, or Firm*—Herbert L. Lerner; Laurence A. Greenberg; Werner H. Stemer

(57) ABSTRACT

A steam turbine has a turbine shaft directed along a turbine axis. A plurality of turbine stages, each include a guide-blade structure and a moving-blade configuration located axially downstream of the guide-blade structure. The guide-blade structure and the moving-blade configuration are provided along the turbine shaft. Each stage has an average reaction degree achievable between 5% and 70%. The reaction degree of at least two turbine stages is of different values.

21 Claims, 3 Drawing Sheets

STEAM TURBINE

CROSS-REFERENCE TO RELATED APPLICATION

This application is a continuation of copending International Application No. PCT/DE98/00063, filed Jan. 9, 1998, which designated the United States.

BACKGROUND OF THE INVENTION

Field of the Invention

The invention relates to a steam turbine having a turbine shaft directed along a turbine axis and a plurality of turbine stages along the turbine shaft, each turbine stage including a guide-blade structure and a moving-blade configuration axially downstream of the guide-blade structure.

Known steam turbines are classified as action turbines (also called "constant-pressure" turbines) and reaction turbines (also called "excess-pressure" turbines). They have a turbine shaft with moving blades disposed on it and have an inner casing with guide blades disposed between axially spaced moving blades.

In the case of a constant-pressure turbine, the entire energy gradient is converted essentially into kinetic flow energy in the ducts that are narrowed by the guide blades. During the process, the velocity rises and the pressure falls. In the moving blades, the pressure and relative velocity remain essentially constant, being achieved through ducts having a uniform clear width. Because the direction of the relative velocity changes, action forces occur that drive the moving blades and, thus, cause rotation of the turbine shaft. The magnitude of the absolute velocity decreases considerably when the flow passes around the moving blades, resulting in a flow that transfers a large part of its kinetic energy to the moving blades and, therefore, to the turbine shaft.

In the case of an excess-pressure turbine, only part of the energy gradient is converted into kinetic energy when the flow passes through the guide blades. The rest of the energy gradient brings about an increase in relative velocity within the moving-blade ducts formed between the moving blades. Where the blade forces are almost exclusively action forces in the constant-pressure turbine, in an excess-pressure turbine, a greater or lesser fraction resulting from the change in the velocity magnitude is added. The term "excess-pressure" turbine is derived from the pressure difference between the downstream and the upstream side of the moving blade. In an excess-pressure turbine, therefore, a change in the velocity magnitude takes place when the pressure varies.

In a thermal turbo-machine, the percentage apportionment of the isentropic enthalpy gradient in the moving blades to the total isentropic enthalpy gradient by a stage having a guide-blade ring and moving-blade ring is designated as the isentropic reaction degree r. A stage in which the reaction degree r is equal to zero and the greatest enthalpy gradient occurs is designated as a pure constant-pressure stage. In the case of a classic excess-pressure stage, the reaction degree r is equal to 0.5, so that the enthalpy gradient in the guide blades is exactly the same as in the moving blades. For example, a reaction degree of r=0.75 is designated as a strong reaction. In steam-turbine construction practice, the classic excess-pressure stage and the constant-pressure stage are predominantly employed. However, as a rule, the latter has a reaction degree r that is somewhat different from zero.

Furthermore, the terms "chamber turbine" and "drum turbine" are also used. Conventionally, a constant-pressure turbine employs a chamber configuration and an excess-pressure turbine employs a drum configuration. A chamber turbine has a casing that is divided into a plurality of chambers through intermediate floors disposed at an axial distance from one another. A disc-shaped rotor, on the outer periphery of which the moving blades are mounted, runs in each of these chambers, while the guide blades are inserted into the intermediate floors. One advantage of the chamber configuration is that the intermediate floors can be sealed off at their inner edge relative to the turbine shaft in a highly effective manner through labyrinth gaskets. Because the labyrinth gasket diameter is small, the gap cross-sections and, therefore, the gap leakage streams both become small. In known turbines, the configuration is used only in the case of low reaction degrees, that is to say a high stage gradient and, therefore, a small number of stages. The pressure difference on the two sides of a rotor disc is small in the case of a low reaction degree and, in the borderline case, is even zero. An axial thrust exerted on the rotor remains low and can be absorbed by an axial bearing.

In a drum turbine, the moving blades are disposed directly on the periphery of a drum-shaped turbine shaft. The guide blades are inserted either directly into the casing of the steam turbine or into a special guide-blade carrier. The moving blades and guide blades may also be provided with covering strips, to which labyrinth gaskets are attached, so that a sealing gap between the guide and moving blades and the turbine shaft and inner casing, respectively, is sealed off. Because these sealing gaps are located on large radii, at least in the case of the moving blades, the gap leakage streams are at all events considerably greater than in the case of chamber turbines. Due to the higher reaction degree, for example r=0.5, favorable flow paths in the blade ducts and, therefore, high efficiencies are achieved. The axial overall length and the outlay for an individual stage are less than in a chamber turbine, but a larger number of stages is required because the reaction stages process a lower gradient. The axial thrust occurring in the blading is considerable. One possibility for counteracting the axial thrust is to provide a compensating piston, to the front side of which the pressure of the outlet port is applied through a connecting conduit.

A steam turbine of the drum configuration is described in German Published, Prosecuted Patent Application 20 54 465, corresponding to U.S. Pat. No. 3,754,833. A turbine shaft carrying the moving blades and an inner casing surrounding the turbine shaft are disposed in a pot-shaped outer casing. The inner casing carries the guide blades. The inner casing is connected to the outer casing via corresponding bearing and centering points for the absorption of an axial thrust.

German Patent No. 312856 describes an excess-pressure steam turbine with a high reaction degree, a plurality of stage groups being disposed in a casing. Different reaction degrees are achieved in the various turbine stages, the start of the group having a reaction degree well above 0.5 and the end of the group having a degree well below 0.5. Stages located at an axial distance from one another have a different reaction degree in each case. A plurality of turbine stages is combined into partial groups, a plurality of partial groups forming an excess-pressure blade group. In a first excess-pressure blade group, the reaction degree in each partial group increases towards the steam outlet, but the average reaction degree of the partial groups decreases towards the steam outlet. In the second excess-pressure blade group assigned to the steam outlet, the reaction degree in each partial group decreases towards the steam outlet. The average reaction degree has a local maximum.

An excess-pressure steam turbine having the drum configuration is specified in German Patent No. 880307. The steam turbine is configured in such a way that, with the exception of the last stage, the reaction degree of the preceding stages increases continuously towards the evaporation region and is well above 0.5. Only in the last stage does the reaction degree fall to a value below 0.5.

A configuration of partial turbines connected fluidically to one another is described in U.S. Pat. No. 1,622,805 to Pape. This patent sought to achieve a higher degree of freedom in the configuration of steam turbines. The embodiments illustrated therein show a high-pressure steam turbine of the chamber configuration in the region of the highest steam pressure. In the same casing, there follows, at a lower steam pressure, a partial-turbine region that is of the drum configuration and has a reaction stage. A following low-pressure partial is of the double-flow configuration.

SUMMARY OF THE INVENTION

It is accordingly an object of the invention to provide a steam turbine, which overcomes the hereinafore-mentioned disadvantages of the heretofore-known devices of this general type and which enables a higher efficiency.

With the foregoing and other objects in view, there is provided, in accordance with the invention, a steam turbine having a turbine shaft directed along a turbine axis, a steam inlet and a steam outlet, a plurality of turbine stages, each one of the plurality of turbine stages having a reaction degree, a guide-blade structure and a moving-blade configuration, the guide-blade structure and moving-blade configuration provided along the turbine shaft, the moving-blade configuration located axially downstream of the guide-blade structure, at least half of the plurality of turbine stages having an average reaction degree below 0.5, and at least two of the plurality of turbine stages having different average reaction degrees. The average reaction degree (average stage reaction) designates the ratio of the enthalpy gradient converted in the moving-blade configuration of the turbine stage to the total enthalpy gradient converted in the turbine stage. The steam turbine is, alternatively or additionally, a drum configuration steam turbine.

High efficiency can be achieved, depending on the area of use of the steam turbine, through a variable rating of the reaction degree. In a steam turbine, through which hot steam flows into a steam inlet and, after flowing through axially, flows out of a steam outlet, the reaction degree varies between the steam inlet and steam outlet. The reaction degree varies preferably from turbine stage to turbine stage, so that, taking into account steam pressure, steam temperature and steam mass flow with a view to particularly high efficiency. A favorable average reaction degree can be determined for each turbine stage as early as during the planning of the steam turbine.

In accordance with another feature of the invention, the reaction degree of each of the plurality of turbine stages varies between 0.05 and 0.7. The reaction degree of each of the plurality of turbine stages varies, alternatively or additionally, between 0.1 and 0.65. In the case of a steam turbine, in particular a partial turbine of drum configuration, the average reaction degree varies, at least in regions, between 5% and 70%, in particular between 10% and 50%, preferably below 45%.

In accordance with a further feature of the invention, the steam inlet has an inlet reaction degree between 0.2 and 0.4, in particular between 0.25 and 0.35, and the steam outlet has an outlet reaction degree between 0.4 and 0.6, in particular between 0.45 and 0.55. Alternatively or additionally, the reaction degree between the steam inlet and the steam outlet has a local extremum (maximum or minimum). The reaction degree between the steam inlet and the steam outlet is, alternatively or additionally, between 0.1 and 0.5.

Depending on the area of use, the average reaction degree may, from turbine stage to turbine stage, rise, fall, or initially have a local extremum (maximum and/or minimum). Preferably, a local maximum is negligible, that is to say it deviates by 0.1 from the value of the reaction degree at the steam inlet or steam outlet. The profile of the reaction degree is preferably monotonically falling or monotonically rising. Preferably, the reaction degree (difference between two turbine stages) varies by 0.1, in particular by more than 0.2. In the case of a steam turbine, in particular a partial turbine of chamber configuration, the average reaction degree is preferably between 5% and 35%, in particular below 20%.

In accordance with an added feature of the invention, at least two of the plurality of turbine stages are combined into a first stage group and at least two of the plurality of turbine stages are combined into a second stage group, the first stage group having a first reaction degree, the second stage group having a second reaction degree, and the first reaction degree differing from the second reaction degree.

In accordance with an additional feature of the invention, there is provided a drum configuration, high-pressure partial turbine, which, alternatively or additionally, has a pot-shaped outer casing, which may also be configured in two axially divided halves.

In accordance with yet another feature of the invention, there is provided a drum configuration, medium-pressure partial turbine, which, alternatively or additionally, has an outer casing. The drum configuration, medium-pressure partial turbine is, alternatively or additionally, of double-flow configuration.

In accordance with yet a further feature of the invention, the outer casing of the drum configuration, high-pressure partial turbine is located at an axial distance from the pot-shaped outer casing of the drum configuration, high-pressure partial turbine.

In accordance with a concomitant feature of the invention, there is provided a drum configuration, high-pressure partial turbine, a drum configuration, medium-pressure partial turbine and a single outer casing, the drum configuration, high-pressure partial turbine and the drum configuration, medium-pressure partial turbine disposed in the single outer casing.

Particularly in the case of a medium-pressure partial turbine, the turbine stages are combined in stage groups, at least the reaction degree of a turbine stage of a first stage group being different from the reaction degree of a turbine stage of a second stage group. It is also possible to provide stage groups in the high-pressure partial turbine.

In the case of a high-pressure partial turbine of drum configuration, a medium-pressure partial turbine located fluidically downstream has a chamber configuration or, preferably, a drum configuration. The high-pressure partial turbine and medium-pressure partial turbine may be disposed in a separate outer casing or in a common outer casing (compact turbine). It is also possible for a medium-pressure partial turbine to have a drum configuration and for an upstream high-pressure partial turbine to have a chamber configuration.

An average stage reaction of a turbine stage of between 10% and 50%, preferably below 45%, gives rise, when steam flows through it, to a lower axial thrust than in the case of an excess-pressure stage with an average reaction degree of 50% and above. A smaller thrust-compensating piston may thereby be provided, with the result that piston leakage steam losses fall and the overall efficiency of the steam turbine rises.

The reaction degree between turbine stages succeeding one another in the direction of flow can thus be made variable. The reaction degree may assume a different value in each case from turbine stage to turbine stage, in particular decrease or increase continuously in the direction of flow. Depending on the area of use of the steam turbine (steam pressure, steam temperature, mass flow and electric and thermal power), a steam turbine of particularly high efficiency in the required area of use can be produced by predetermining the average reaction degree of each turbine stage.

Both a high-pressure partial turbine and a medium-pressure partial turbine can have a drum configuration and that one turbine stage or a plurality of turbine stages, if not even all the turbine stages, can be configured with an average reaction degree of below 50%, in particular below 45%.

Other features, which are considered as characteristic for the invention, are set forth in the appended claims.

Although the invention is illustrated and described herein as embodied in a steam turbine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
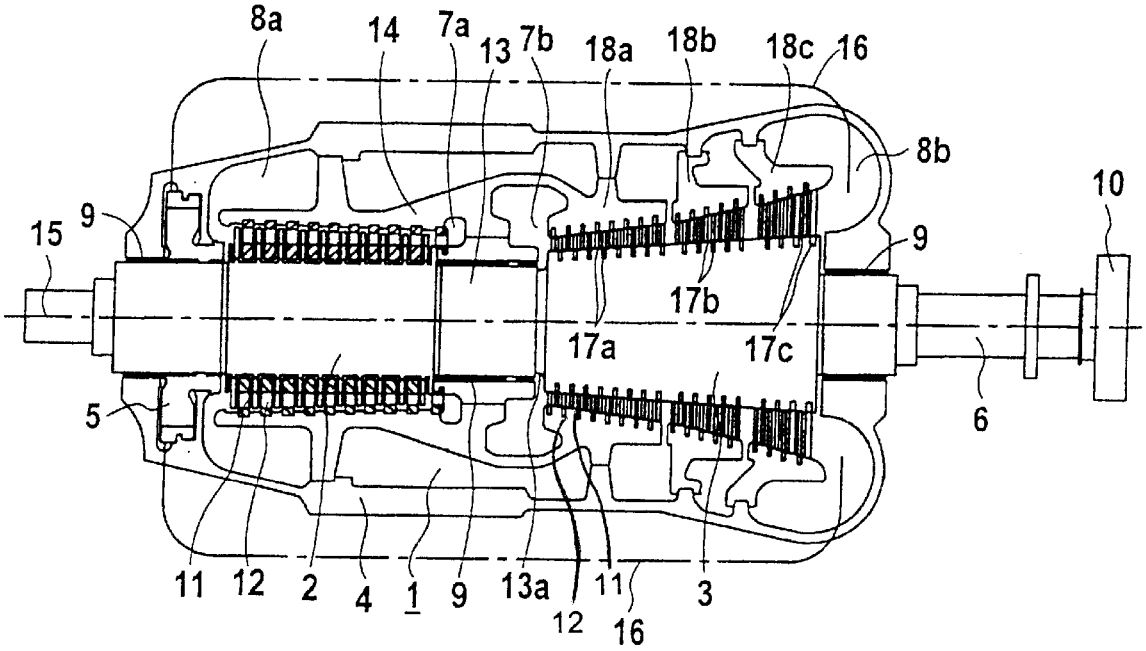
FIG. 1 is a diagrammatic, longitudinal-sectional view through a single-casing steam turbine with a high-pressure partial turbine of chamber configuration and a medium-pressure partial turbine of drum configuration according to the invention.

Referring now to the figures of the drawings in detail and first, particularly, to FIG. 1 thereof, there is seen a steam turbine 1 with a single outer casing 4. A turbine shaft 6 directed along a turbine axis 15 is led through the outer casing 4. The turbine shaft 6 is sealed off relative to the outer casing 4 at the leadthroughs, not illustrated in any more detail, through respective shaft gaskets 9. A high-pressure partial turbine 2 of a chamber configuration is disposed within the outer casing 4. The steam turbine 1 has high-pressure blading including a moving-blade configuration 11 connected to the turbine shaft 6 and guide-blade structures 12, illustrated diagrammatically, connected to a high-pressure inner casing 14. Furthermore, a medium-pressure partial turbine 3 of a drum configuration, with a moving-blade configuration 11 and guide-blade structures 12, which once again are illustrated diagrammatically for the sake of clarity, is disposed within the inner casing 14. The turbine shaft 6 has, at one end, a shaft coupling 10 for coupling to a non-illustrated generator or a non-illustrated low-pressure partial turbine. A region 13 (intermediate floor) of the turbine shaft 6 is configured axially between the high-pressure blading and the medium-pressure blading, the region 13 being sealed off relative to the inner casing 14 through a corresponding shaft gasket 9. Towards the medium-pressure partial turbine 3, the turbine shaft 6 has, in the intermediate floor 13, a depression 13*a*, through which end faces are formed on the intermediate floor 13. The intermediate floor 13 is connected fluidically to a steam inlet 7*a* of the high-pressure partial turbine 2 through an inflow region 7*b* of the medium-pressure partial turbine 3. Fresh steam flowing into the steam inlet 7*a*, for example at a pressure of approximately 170 bar and at 560° C., flows in the axial direction through the blading of the high-pressure partial turbine 2 and out of the steam outlet 8*a* of the high-pressure partial turbine 2 at a lower pressure. The now partly expanded steam passes from there into an intermediate superheater, not illustrated, and is supplied to the steam turbine 1 again by the steam inlet 7*b* of the medium-pressure partial turbine 3. The intermediately superheated steam, flowing into the steam inlet 7*b* and flowing axially through the medium-pressure partial turbine 3, leaves the medium-pressure partial turbine 3 through steam outlet 8*b*. The turbine stages 17*a*, 17*b*, 17*c* formed in each case by a guide-blade structure 12 and a moving-blade configuration 11 located downstream in the direction of flow, are subdivided into three stage groups 18*a*, 18*b*, 18*c*. Preferably, the average reaction degree of the turbine stages 17*a* is higher than that of the turbine stages 17*b* which, in turn, is higher than the reaction degree of the turbine stages 17*c*. The reaction degree may also fall or alternately rise and fall, depending on the intended area of use of the steam turbine. It is also possible for the reaction degree of turbine stages 17*a*, 17*b*, 17*c* of a respective stage group 18*a*, 18*b*, 18*c* to vary, in particular to vary from turbine stage to turbine stage in the direction of the steam outlet 8*b*.

In order to absorb an axial thrust of the medium-pressure partial turbine 3 of drum configuration, a thrust-compensating piston 5 is provided, which is connected via a pressure conduit 16 to the steam outlet 8*b* of the medium-pressure partial turbine 3. The thrust-compensating piston 5 is disposed on the steam outlet side of the high-pressure partial turbine 2, so that the high-pressure partial turbine 2 is disposed axially between the thrust-compensating piston 5 and the intermediate floor 13, that is to say the medium-pressure partial turbine 3. A low-pressure partial turbine may be located downstream of the steam turbine 1 in a similar way to the embodiment according to FIG. 1.

Figure 2:
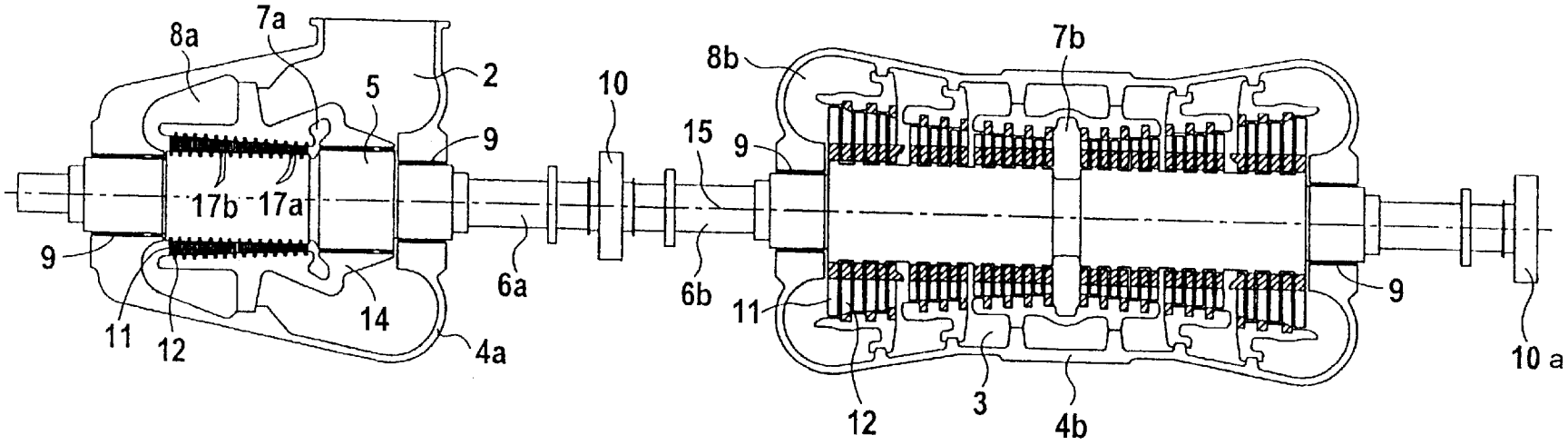
FIG. 2 is a longitudinal-sectional view of a steam turbine, with a high-pressure partial turbine and medium-pressure partial turbine disposed in outer casings separated from one another.

FIG. 2 shows a steam turbine 1 having a high-pressure partial turbine 2 with an outer casing 4*a* and a medium-pressure partial turbine 3 located at an axial distance from the high- pressure partial turbine and with an outer casing 4*b*. The medium-pressure partial turbine 3 is of a double-flow configuration. A turbine shaft 6*a* of the high-pressure partial turbine 2 being led through the outer casing 4*a* is coupled by a shaft coupling 10 to a turbine shaft 6*b* led through the outer casing 4*b* of the medium-pressure partial turbine 3. Disposed on the turbine shaft 6*b* is a further shaft coupling 10*a* for coupling to a generator, not illustrated, or to a low-pressure partial turbine, not illustrated. The high-pressure partial turbine has a drum configuration and the medium-pressure partial turbine has a chamber configuration. An intermediate floor configured as a thrust-compensating piston 5 is disposed axially between the steam inlet 7*a* and the outer casing 4*a*. The intermediate floor is connected fluidically to the steam outlet 8*a* on the casing side, so that the pressure difference between the steam inlet 7*a* and steam outlet 8*a* corresponds essentially to the pressure drop in the axial direction across the thrust-compensating piston 5. Reference is made to the description regarding FIG. 1 for the features of the high-pressure partial turbine 2 and of the medium-pressure partial turbine 3, which relate to configuration and functioning.

Figure 3:
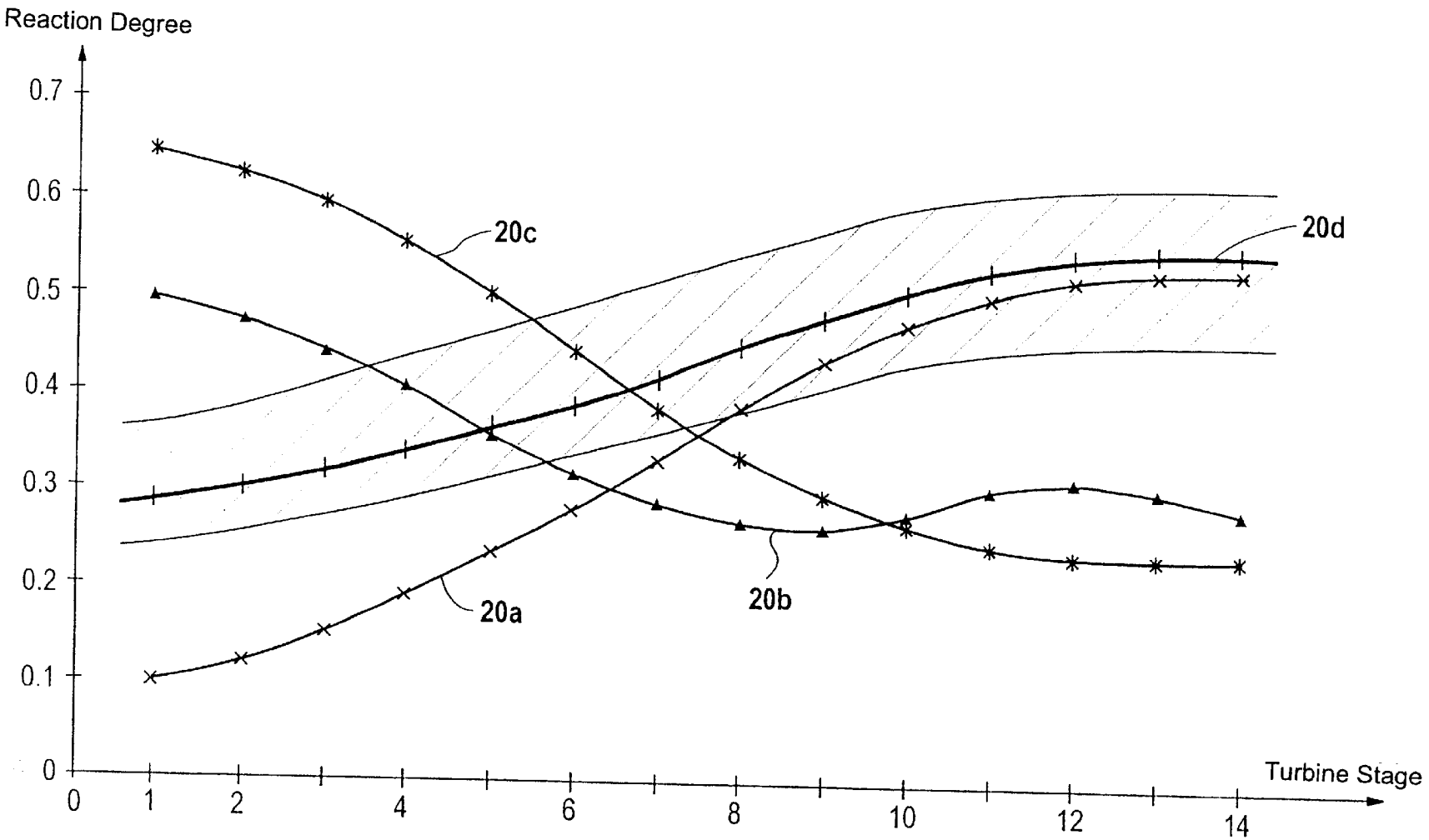
FIG. 3 is a graph profiling a reaction degree over a plurality of turbine stages.

In the high-pressure partial turbine 2, the guide-blade structures 12 are disposed in an axially continuous inner casing 14 without any subdivision into stage groups. The reaction degree of a turbine stage 17*a* is higher than the reaction degree of a turbine stage 17*b* located downstream in the direction of flow. A steam flow is directed axially from the steam inlet 7*a* in the direction of the steam outlet 8*a*. FIG. 3 illustrates by way of example, with reference to four curves 20*a*, 20*b*, 20*c* and 20*d*, the profile of the reaction degree r over a plurality of turbine stages (here, 14 in total) located one after the other in the direction of flow. Turbine stage No. 1 is assigned to a steam inlet region 7*a*, 7*b* and turbine stage No. 14 to a steam outlet 8*a*, 8*b*. According to curve 20*c*, the reaction degree r, starting from the value 0.65 of turbine stage No. 1, decreases monotonically to the reaction degree r=0.25 of turbine stage No. 14. The profile of the reaction degree r according to curve 20*a* commences with the value 0.1 at turbine stage No. 1 and rises continuously to the value of approximately 0.55 for the turbine stages located one after the other in the direction of flow. A profile of the reaction degree r through the curve 20*b* is illustrated for a further area of use of the steam turbine and has a value of 0.5 at turbine stage No. 1, falls continuously as far as turbine stage No. 9 to a minimum value of approximately 0.25, rises continuously again to the value of approximately 0.3 as far as turbine stage No. 12 and falls to the value of 0.275 at turbine stage No. 14. The fourth curve 20*d* lies in a monotonically rising band of the average reaction degree. The band has a band width between steam inlet 7*a*, 7*b* and steam outlet 8*a*, 8*b* on the order of magnitude of 0.2. The band at turbine stage No. 1 has a range between approximately 0.2 and 0.4 and a range between approximately 0.4 and 0.6 at turbine stage No. 14.

The invention is distinguished by a steam turbine that has a reaction degree for a turbine stage of between 5% and 75%. Preferably, the average reaction degree of turbine stages succeeding one another in the direction of flow has an essentially monotonic profile between the steam inlet 7*a*, 7*b* and steam outlet 8*a*, 8*b*. The reaction degree may increase, decrease, or alternate, depending on the area of use of the steam turbine.

We claim:

1. A steam turbine, consisting of:

a turbine axis;

a turbine shaft directed along said turbine axis;

a steam inlet;

a steam outlet fluidically connected to said steam inlet;

a plurality of turbine stages between said steam inlet and said steam outlet, each of said plurality of turbine stages having a reaction degree, a guide-blade structure and a moving-blade configuration, said guide-blade structure and said moving-blade configuration provided along said turbine shaft, said moving-blade configuration located axially downstream of said guide-blade structure, at least half of said plurality of turbine stages having an average reaction degree below 0.5, and at least two of said plurality of turbine stages having different average reaction degrees.

2. The steam turbine according to claim 1, wherein said average reaction degree of each of said plurality of turbine stages varies between 0.05 and 0.7.

3. The steam turbine according to claim 1, wherein a turbine stage assigned to said steam inlet has an inlet reaction degree between 0.2 and 0.4 and a turbine assigned to said steam outlet has an outlet reaction degree between 0.4 and 0.6.

4. The steam turbine according to claim 1, wherein a reaction degree between said steam inlet and said steam outlet has a local extremum.

5. The steam turbine according to claim 4, wherein said reaction degree between said steam inlet and said steam outlet is between 0.1 and 0.5.

6. The steam turbine according to claim 2, including a drum configured partial steam turbine, and said average reaction degree of each of said plurality of turbine stages varying between 0.1 and 0.65.

7. The steam turbine according to claim 1, wherein at least two of said plurality of turbine stages are combined into a first stage group and at least two of said plurality of turbine stages are combined into a second stage group, said first stage group having a first reaction degree and said second stage group having a second reaction degree differing from said first reaction degree.

8. The steam turbine according to claim 1, including a drum configured high-pressure partial turbine fluidically connected to said steam inlet and said steam outlet.

9. The steam turbine according to claim 8, wherein said drum configured high-pressure partial turbine has a pot-shaped outer casing.

10. The steam turbine according to claim 9, including a drum configured medium-pressure partial turbine fluidically connected to said drum configured high-pressure partial turbine, said steam inlet and said steam outlet.

11. The steam turbine according to claim 10, wherein said drum configured medium-pressure partial turbine has an outer casing.

12. The steam turbine according to claim 10, wherein said drum configured medium-pressure partial turbine is of a double-flow configuration.

13. The steam turbine according to claim 11, wherein said outer casing is located at an axial distance from said pot-shaped outer casing.

14. The steam turbine according to claim 1, including a drum configured medium-pressure partial turbine fluidically connected to said steam inlet and said steam outlet.

15. The steam turbine according to claim 14, wherein said drum configured medium-pressure partial turbine has an outer casing.

16. The steam turbine according to claim 14, wherein said drum configured medium-pressure partial turbine is of a double-flow configuration.

17. The steam turbine according to claim 15, including a drum configured high-pressure partial turbine fluidically connected to said drum configured medium-pressure partial turbine, said steam inlet and said steam outlet.

18. The steam turbine according to claim 17, wherein said drum configured high-pressure partial turbine has a pot-shaped outer casing.

19. The steam turbine according to claim 18, wherein said outer casing is located at an axial distance from said pot-shaped outer casing.

20. The steam turbine according to claim 1, including a drum configured high-pressure partial turbine, a drum configured medium-pressure partial turbine and a single outer casing, said drum configured high-pressure partial turbine and said drum configured medium-pressure partial turbine disposed in said single outer casing.

21. The steam turbine according to claim 20, wherein said drum configured medium-pressure partial turbine is of a double-flow configuration.

* * * * *